US006691964B1

(12) United States Patent
Schaefer

(10) Patent No.: US 6,691,964 B1
(45) Date of Patent: Feb. 17, 2004

(54) EASY VIEW INVISIBLE MOUNTING SYSTEM

(75) Inventor: Markus V. Schaefer, Washington Crossing, PA (US)

(73) Assignee: PGM Products, LLC, Barrington, NJ (US)

( * ) Notice: Subject to any disclaimer, the term of this patent is extended or adjusted under 35 U.S.C. 154(b) by 0 days.

(21) Appl. No.: 10/387,165

(22) Filed: Mar. 12, 2003

(51) Int. Cl.[7] ..... E06B 7/28

(52) U.S. Cl. ..... 248/250; 248/685; 248/235; 248/201; 248/205.1; 248/220.21; 108/108; 312/245

(58) Field of Search ..... 108/108; 248/250, 248/235, 236, 221.72, 222.41, 220.21, 685, 201, 339, 207, 205.1; 403/403, 382, 13, 14; 126/33; 211/90.01, 183, 153; 312/245

(56) References Cited

U.S. PATENT DOCUMENTS

| | | | | | |
|---|---|---|---|---|---|
| 1,010,473 | A | * | 12/1911 | Wittels | 248/207 |
| 1,229,427 | A | * | 6/1917 | Erismann | 248/243 |
| 1,254,094 | A | * | 1/1918 | Vogt | 248/243 |
| 1,847,486 | A | * | 3/1932 | Keil | 248/243 |
| 1,861,100 | A | * | 5/1932 | Stanitz | 248/225.21 |
| 2,053,119 | A | * | 9/1936 | Sturtevant | 248/223.21 |
| 2,324,655 | A | * | 7/1943 | Tozer | |
| 2,352,406 | A | * | 6/1944 | Pond | 248/685 |
| 3,265,344 | A | * | 8/1966 | Ornstein | 248/243 |
| 3,311,073 | A | * | 3/1967 | Colledge | 108/149 |
| 3,572,263 | A | * | 3/1971 | Propst | 108/152 |
| 3,801,175 | A | * | 4/1974 | Giulie | 312/184 |
| 4,051,789 | A | * | 10/1977 | Howitt | 108/152 |
| 4,632,242 | A | * | 12/1986 | Choi et al. | 206/45.24 |
| 4,660,901 | A | * | 4/1987 | Shimada | 312/111 |
| 5,117,987 | A | * | 6/1992 | Lombardo | 211/105.1 |
| 5,446,618 | A | * | 8/1995 | Tetsuya et al. | 361/683 |
| 5,727,646 | A | * | 3/1998 | Gray | 182/45 |
| 6,065,724 | A | * | 5/2000 | Arslan et al. | 248/248 |
| 2002/0089270 | A1 | * | 7/2002 | Hughes | 312/263 |

* cited by examiner

*Primary Examiner*—Kimberly Wood
(74) *Attorney, Agent, or Firm*—Amster, Rothstein & Ebenstein

(57) ABSTRACT

An easy viewing invisible mounting system includes a right angle bracket and a substantially planar, longitudinally extending hanger. The hanger defines, adjacent its top end, a circular aperture adapted to receive a fastener therethrough to mount the hanger on the wall, and, remote from its top end, a longitudinally aligned and spaced apart pair of elongated slots oriented parallel to a longitudinal axis of the hanger. A fastener extends through each slot to secure the hanger to the bracket vertical edge while enabling limited relative vertical sliding movement thereof along the hanger longitudinal axis, whereby the hanger may be slid in one direction for storage with the entirety of the hanger disposed on the bracket vertical edge or slid in the opposite direction to expose the aperture above the bracket for viewing during mounting of the hanger on the wall. The system may include a pair of the hangers, one on each bracket edge, and one or both hangers may afford a shelf-lock feature.

21 Claims, 9 Drawing Sheets

FIG. 2
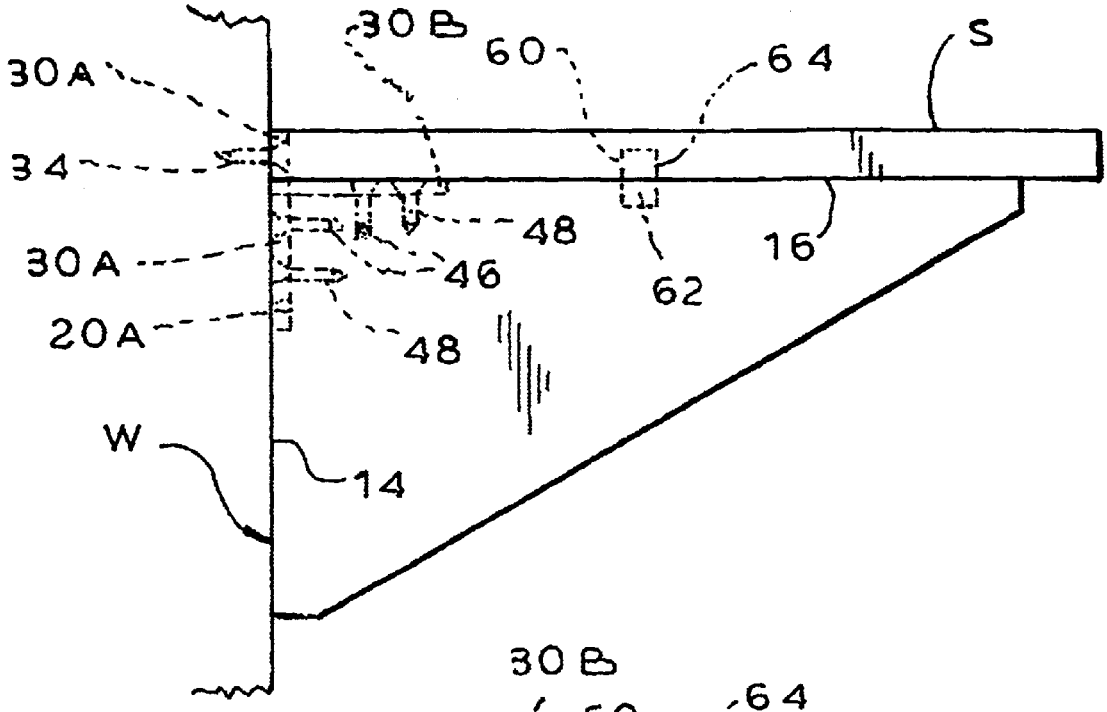
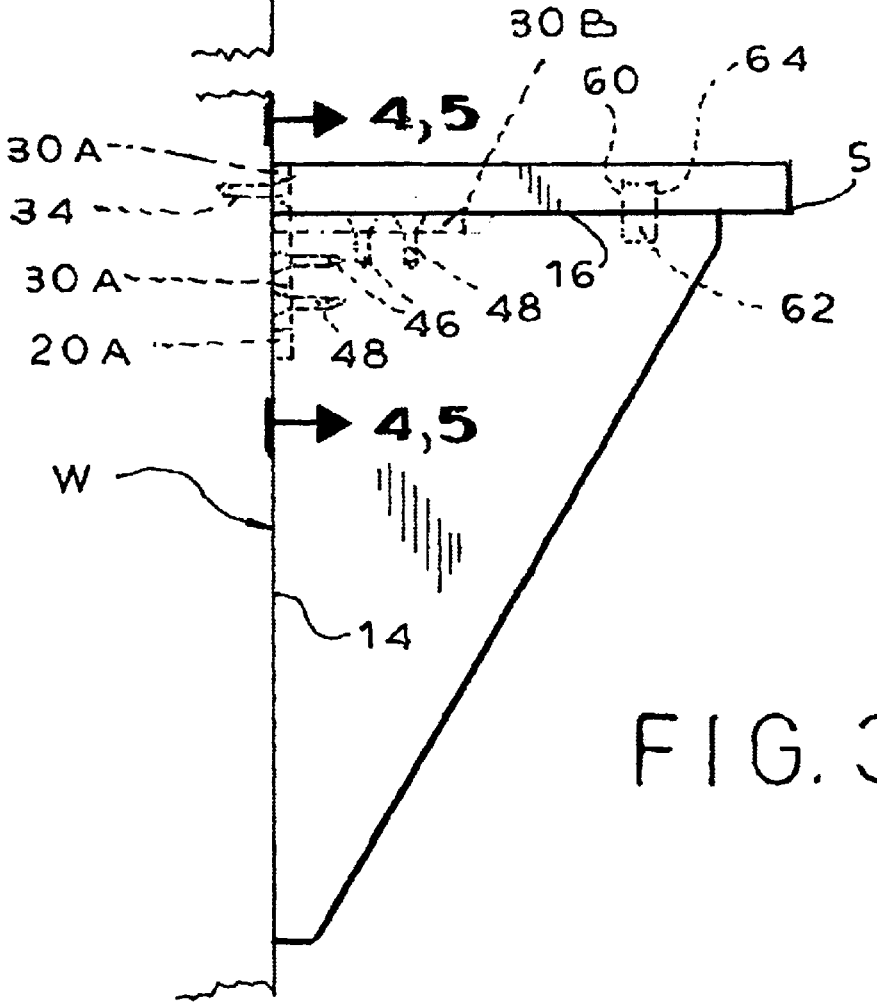
FIG. 3

EASY VIEW INVISIBLE MOUNTING SYSTEM

BACKGROUND OF THE INVENTION

The present invention relates to an invisible mounting system of the type used for shelf brackets, and more particularly such a mounting system which is easy to mount on a wall or like support.

In the past, in order to invisibly hang a shelf, one utilized a standard keyhole plate containing a pair of outer circular apertures and therebetween a keyhole designed to stood slightly in front of the wall when the plate was mounted. On the back of the bracket a rearwardly projecting key was provided, the key being configured and dimensioned to fit into the keyhole slot of the plate (between the plate and wall) after the plate was fastened to the wall using screws or nails passing through the two outer circular apertures. The attempt to fit the key (hidden behind the bracket) into the keyhole slot of the plate (also hidden by the bracket) was a "blind" operation and thus difficult and timeconsuming.

More recently, the "blind" operation has been eliminated by providing the bracket with a stationary hanger having three circular apertures axially aligned along a longitudinal axis of the hanger. The stationary hanger comes with the bracket and is pre-affixed thereto by nails or screws passing through the two bottom circular apertures and into the bracket. As the top portion of the hanger containing the top circular aperture extended above the bracket, to hang the hanger/bracket assembly on a wall, the mounter had only to fix the assembly to the wall, using a screw or nail passing through the top circular aperture of the hanger. This was easy to do as the third hole was visible, peeking over the top of the bracket. The shelf was then placed on top of the bracket with the thickness of the shelf being sufficient to cover the top portion of the hanger containing the top circular aperture, thereby rendering the mounting "invisible".

The improved mounting system was not entirely satisfactory from the point of view of either the manufacturer or the mounter. The bracket mounting system (with the hangers already attached to the bracket) was typically sold in paperboard boxes, or, more economically, simply with a clear plastic wrap or covering thereon, thereby to enable viewing of the system by a potential purchaser. As the top end of the hanger (that is, the portion of the hanger containing the top circular aperture) extended beyond the bracket, it frequently resulted in tearing or puncture of the paperboard or plastic packaging during rough handling or shipment of the packaged mounting system.

The bracket of the improved mounting system was often provided with a recess on the upper surface thereof for receiving the bottom half of a dowel, but it was necessary for the mounter to drill a corresponding dowel-receiving recess in the bottom surface of the shelf, over the bracket recess, so that a dowel could be used to fix the position of the shelf relative to the bracket and prevent the shelf from accidentally horizontally sliding off the bracket. As there was no uniform distance for placement of the bracket recess away from the wall, the mounter had to use a drill to create the recess in the shelf bottom surface a corresponding distance away from the wall. This required the use of a drill, and a certain amount of skill with the drill; it was both timeconsuming, arduous and often challenging for the mounter.

Further, even in the improved mounting system, the mounter was forced to hang the mounting system on the wall in the orientation selected by the manufacturer (who placed the hanger on what was to be the wall-facing edge of the bracket). Especially where the bracket had two short orthogonal edges of unequal length or where the design of the bracket along the long hypotenuse edge was not symmetrical about its midpoint, the consumer might prefer hanging the bracket in an orientation different from that intended by the manufacturer, either to better match the width of the shelf to be placed thereon or to present the design on the long hypotenuse edge of the bracket differently.

Accordingly, it is an object of the present invention to provide an easy viewing invisible mounting system wherein in a preferred embodiment the hanger is easily mounted on the wall because the hanging (top) aperture thereof extends above the horizontal edge of the bracket for easy viewing during the mounting procedure and yet is entirely covered by the shelf which is later placed on the bracket.

Another object is to provide such mounting system which in a preferred embodiment enables the mounter to decide the orientation of the bracket on the wall.

A further object is to provide such a mounting system wherein in a preferred embodiment prior to use no portion of the hanger projects outwardly from the bracket, thus reducing the likelihood of tearing of the package.

It is also an object of the present invention to provide such a mounting system wherein in a preferred embodiment the relative positions of the shelf and the bracket may be fixed without the use of a dowel or drilling of a dowel-receiving recess in the shelf.

It is another object to provide such a mounting system which is simple and inexpensive to manufacture and use.

SUMMARY OF THE INVENTION

It has now been found that the above and related objects of the present invention are obtained in an easy viewing invisible mounting system according to the present invention. In a preferred embodiment thereof, the mounting system comprises a right angle bracket, a substantially planar and longitudinally extending hanger and a pair of fastener means. The right angle bracket defines a vertical edge for facing a wall and a top horizontal edge for supporting a shelf or the like. The substantially planar, longitudinally extending hanger defines, adjacent a top end thereof, a circular aperture configured and dimensioned to receive a fastener therethrough to mount the hanger on the wall, and, remote from the top end thereof, a longitudinally aligned and spaced apart pair of elongated slots oriented parallel to a longitudinal axis of the hanger. Each fastener means of the pair extends through a respective one of the slots and secures the hanger to the bracket vertical edge while enabling limited relative vertical sliding movement of the hanger and the bracket along a longitudinal axis of the hanger. Thus, the hanger may be slid in one direction for storage with the entirety of the hanger disposed on the bracket vertical edge or slid in the opposite direction to expose the aperture above the bracket for viewing during mounting of the hanger on the wall.

The aperture and the pair of slots are vertically aligned along a longitudinal axis of the hanger. Each of the slots has a longitudinal length at least equal to the longitudinal length between the hanger top end and the bottom of the aperture. Preferably, the aperture and the slots are each countersunk on at least one side of the hanger, and the bracket vertical edge defines a recess configured and dimensioned to receive the hanger with the hanger top end flush with the bracket top horizontal edge.

A preferred embodiment includes a second hanger and a second pair of the fastener means, the second pair of the fastener means securing the second hanger to the bracket top horizontal edge. The second pair of fastener means enables limited relative horizontal sliding movement of the second hanger and the bracket along a longitudinal axis of the second hanger, whereby either the hanger or the second hanger may be used to mount the bracket on the wall, as desired by the mounter thereof. Preferably, one of the slots of the second hanger is a keyhole slot having a relatively wide central keyhole and a narrow portion communicating with and extending toward the bracket vertical edge. One of the second pair of fastener means has a shank and an enlarged head, the shank initially extending through the central keyhole. The one fastener means is removable from the keyhole slot by the user and the shank is then securable by the user to the bottom surface of a shelf such that the enlarged head thereof projects downwardly from the bottom surface of the shelf for insertion through the central keyhole and thereafter for sliding movement forwardly into the narrow portion of the keyhole slot as the shelf is placed downwardly on the bracket top horizontal edge and thereafter slid towards the wall with the enlarged head being trapped by the narrow portion of the keyhole slot.

Preferably, one of the slots of the second hanger is a double-ended keyhole slot having a relatively wide central keyhole, a first narrow portion communicating with and extending toward the bracket vertical edge, and a second narrow portion communicating with and extending away from the bracket vertical edge. One of the second pair of fastener means has a shank and an enlarged head, the shank initially extending through the central keyhole. The one fastener means is removable from the keyhole slot by the user and the shank is then securable by the user to the bottom surface of a shelf such that the enlarged head thereof projects downwardly from the bottom surface of the shelf for insertion through the central keyhole and thereafter for sliding movement forwardly into the first narrow portion of the keyhole slot as the shelf is placed downwardly on the bracket top horizontal edge and thereafter slid towards the wall with the enlarged head being trapped by the first narrow portion of the keyhole slot.

The present invention further encompasses, in combination, a pair of the mounting systems and a shelf adapted to be mounted generally horizontally on the wall by the mounting systems, the shelf being sufficiently thick to conceal the hanger top ends from view when the shelf is mounted on the bracket top horizontal edges. Preferably, the system additionally including a dowel, the bottom surface of the shelf and the bracket top horizontal surface each defining an aperture configured and dimensioned to receive therein a respective end of the dowel.

In a further preferred embodiment, the system additionally comprises a substantially planar, longitudinally extending second hanger defining adjacent a top end thereof, a second circular aperture configured and dimensioned to receive a fastener therethrough to mount the second hanger on the wall, and remote from the top end thereof, a longitudinally aligned and spaced apart pair of elongated second slots oriented parallel to a longitudinal axis of the second hanger. The system further comprises a pair of second fastener means, each second fastener means extending through a respective one of the second slots and securing the second hanger to the bracket vertical edge while enabling limited relative sliding movement of the second hanger and the bracket along a longitudinal axis of the second hanger. Thus, the second hanger may be slid in one direction for storage with the entirety of the second hanger disposed on the bracket vertical edge or slid in the opposite direction to expose the second circular aperture above the bracket for viewing during mounting of the second hanger on the wall.

In an alternate embodiment, the substantially planar, longitudinally extending second hanger on the other bracket edge is stationary and defines a second aperture and an elongated second slot oriented parallel to a longitudinal axis of the second hanger, the second slot of the second hanger being a keyhole slot having a relatively wide keyhole and a narrow portion communicating with and extending toward the one bracket edge. A pair of second fastener means is provided, one of the second fastener means having a shank and an enlarged head, the shank thereof initially extending through the keyhole. The other second fastener means extends through the central aperture and secures the second hanger to the other bracket edge. The one second fastener means is removable from the keyhole slot by the user, the shank thereof then being securable by the user to the bottom surface of a shelf or the like such that the enlarged head thereof projects downwardly from the bottom surface of the shelf for insertion through the keyhole and thereafter for sliding movement forwardly into the narrow portion of the keyhole slot as the shelf is placed downwardly on the other bracket edge and thereafter slid towards the wall with the enlarged head being trapped by the narrow portion of the keyhole slot.

BRIEF DESCRIPTION OF THE DRAWING

The above and related objects, features and advantages of the present invention will be more fully understood by reference to the following detailed description of the presently preferred, albeit illustrative, embodiments of the present invention wherein:

FIGS. 2 and 3 are side elevation views of the mounting system with the bracket illustrated in different orientations on a fragmentarily shown wall;

DETAILED DESCRIPTION OF THE PREFERRED EMBODIMENTS

Figure 1:
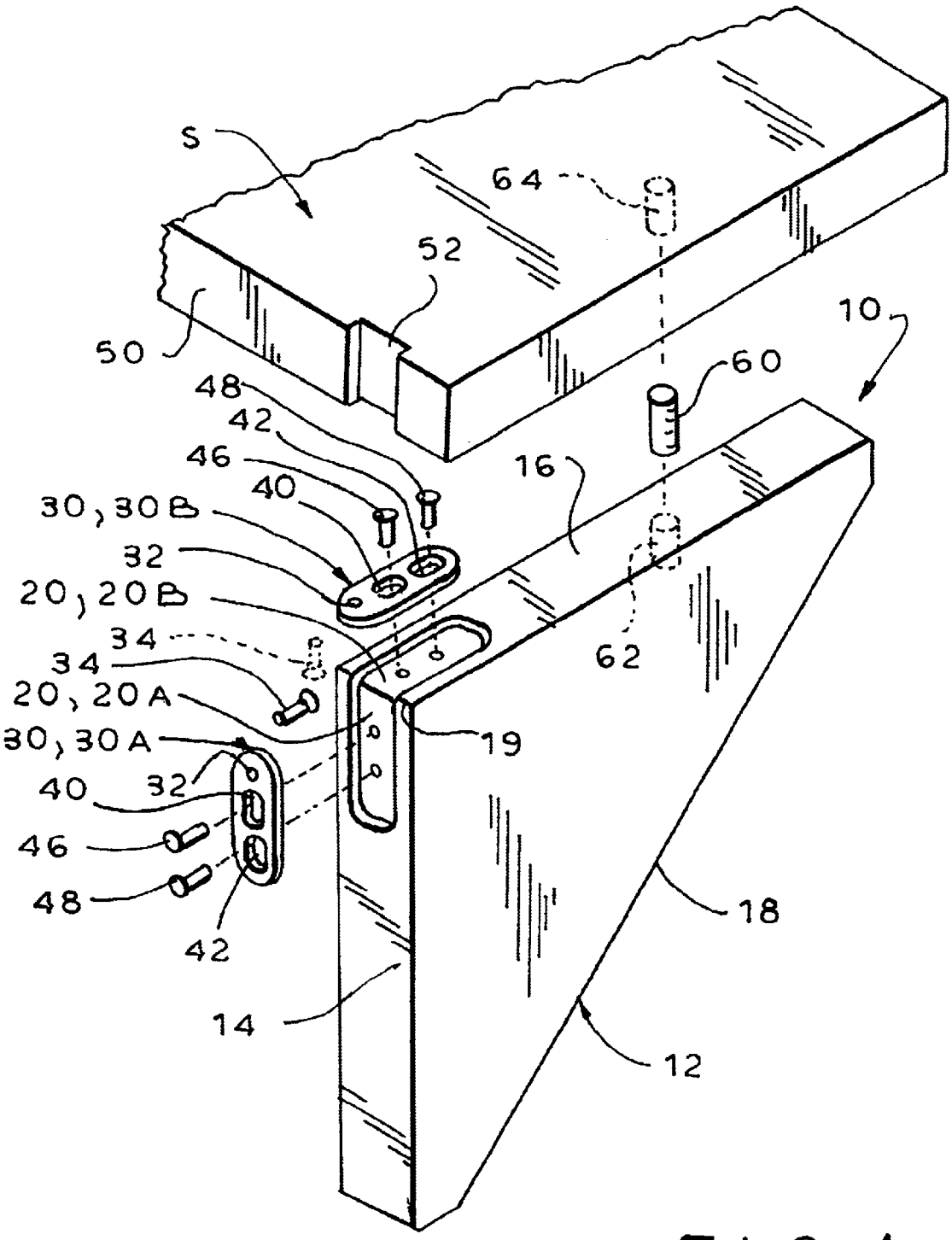
FIG. 1 is a fragmentary exploded isometric view of the mounting system of the present invention and a shelf supported thereby.
Figure 4:
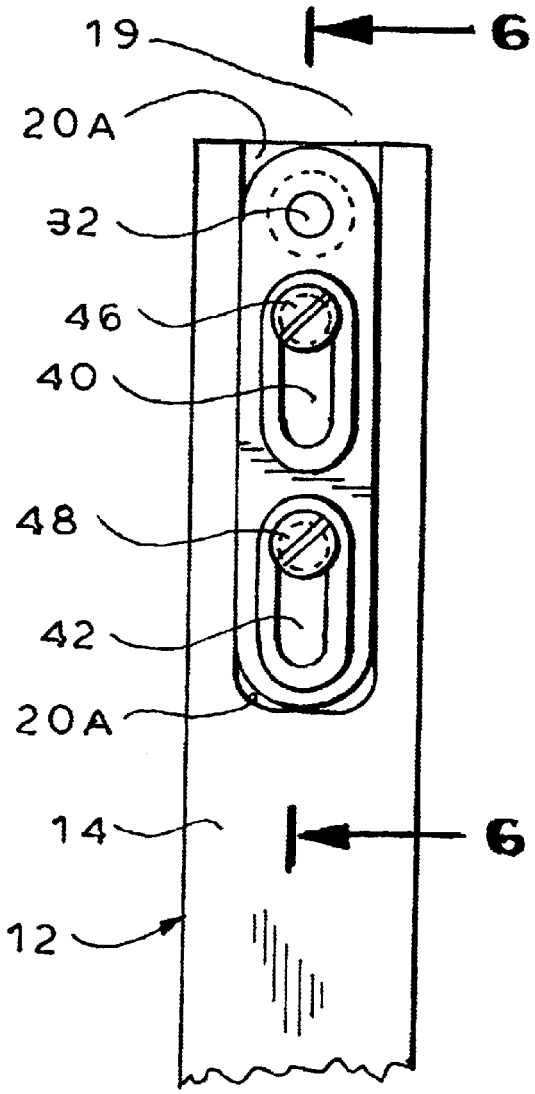
FIGS. 4 and 5 are fragmentary back elevational views, to an enlarged scale, of the mounting system taken along the lines 4—4 and 5—5, respectively, of FIG. 3, with FIG. 4 showing the hanger in a retracted or storage orientation and FIG. 5 showing the hanger in an extended or use orientation (with a shelf being fragmentarily indicated in phantom line)
Figure 5:
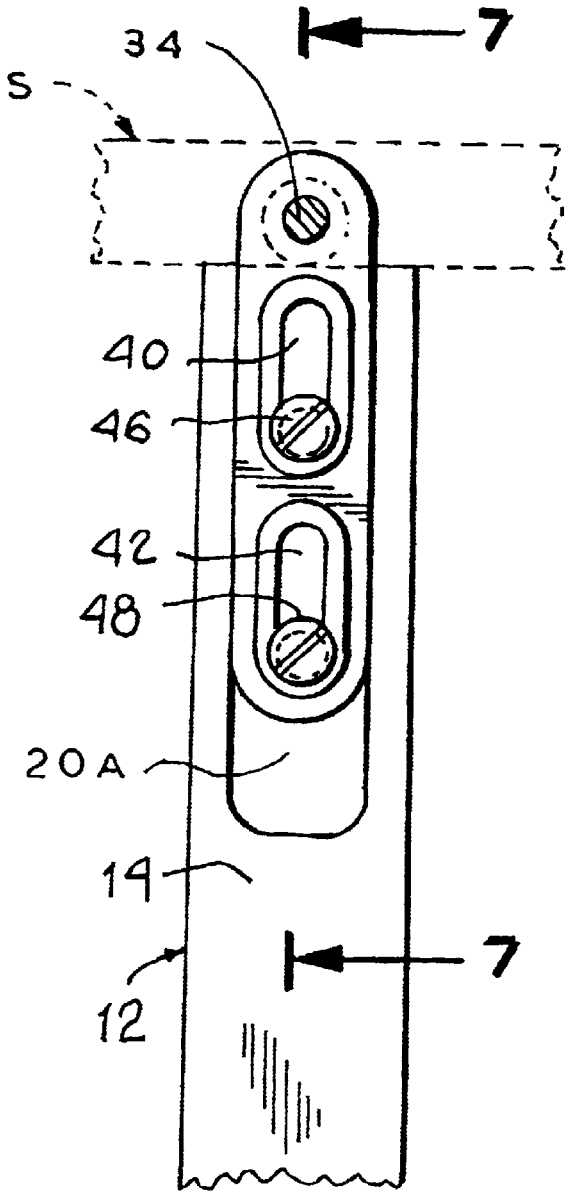
Figure 6:
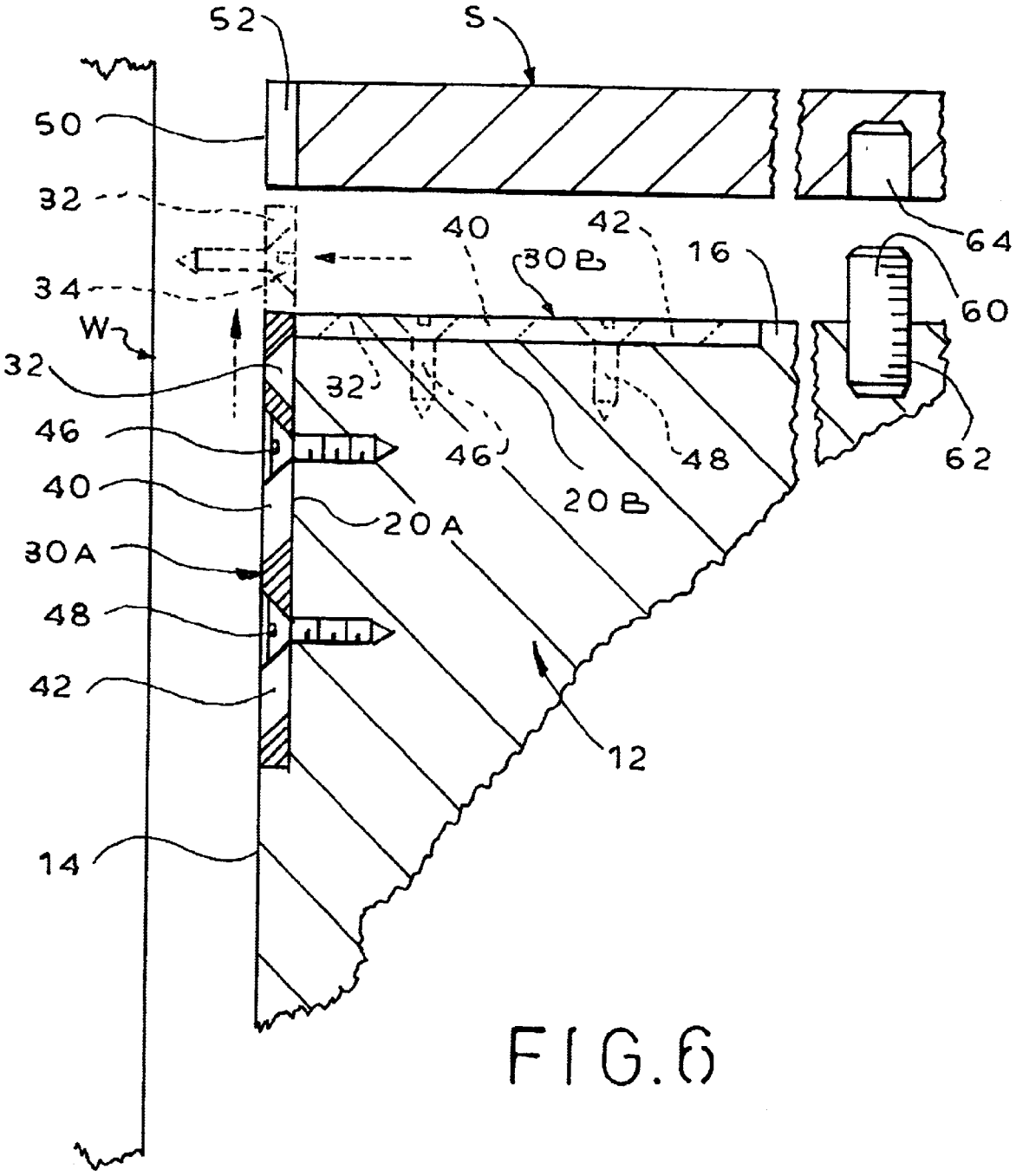
FIGS. 6 and 7 are fragmentary side elevational sections, to an enlarged scale, of the mounting system and a shelf, taken along the lines 6—6 of FIG. 4 and 7—7 of FIG. 5, respectively, with FIG. 6 showing in phantom line the hanger being secured to a wall prior to placement of the shelf on the bracket, and FIG. 7 showing the shelf in its final position on the bracket.
Figure 7:
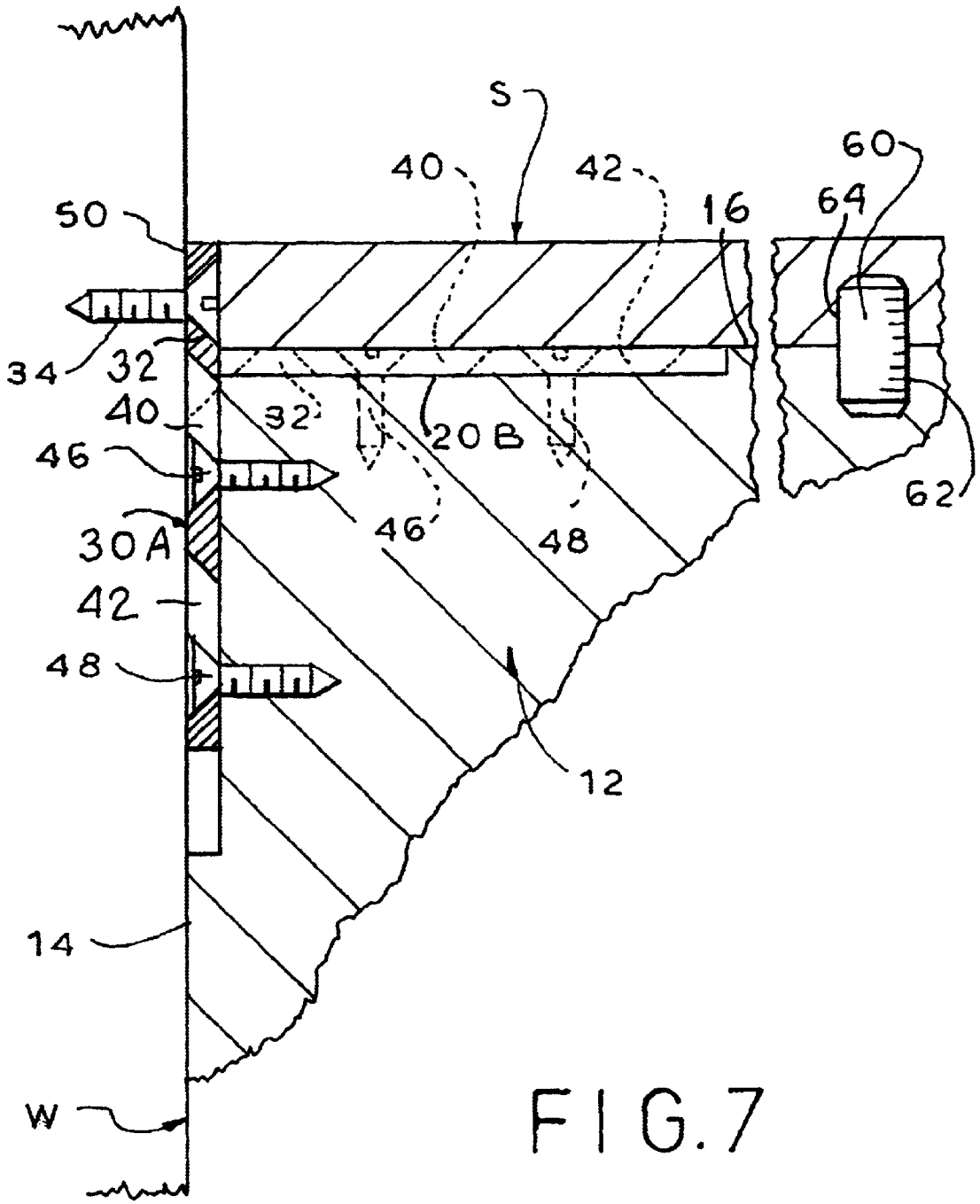
Figure 8:
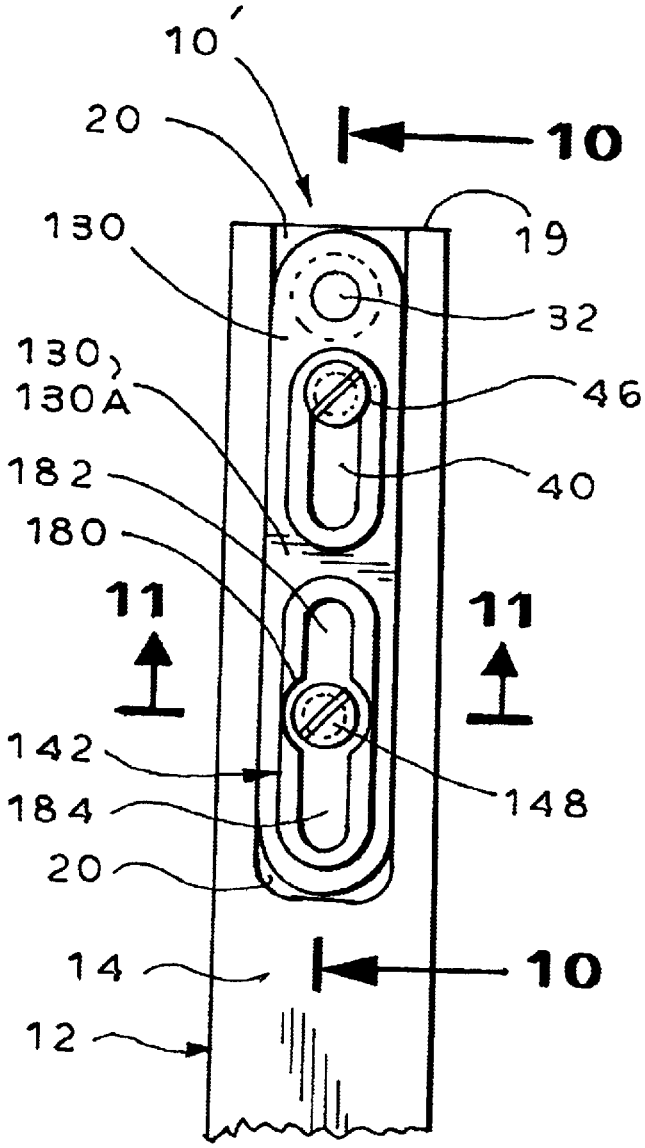
FIGS. 8 and 9 are fragmentary top elevational views of a mounting system incorporating a shelf-lock feature, with FIG. 8 showing the hanger as purchased (with the hanger retracted), and FIG. 9 showing the hanger being used as a simple retractable hanger, without use of the shelf-lock feature.
Figure 9:
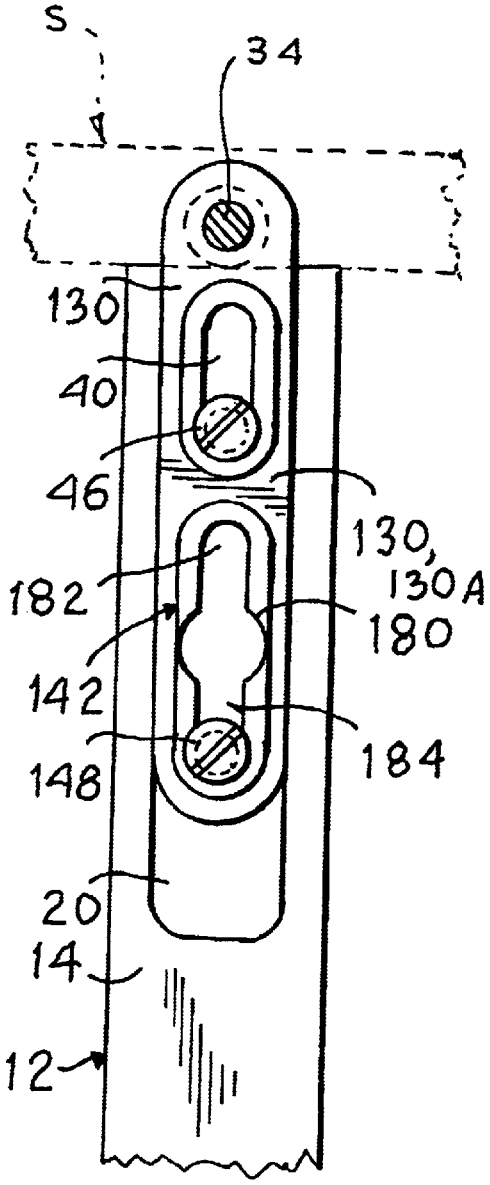

Referring now to the drawing, and in particular FIGS. 1–7 thereof, therein illustrated is a first preferred embodiment of the present invention characterized by at least one retractable hanger, as explained hereinafter.

Referring now in particular to FIG. 1, therein illustrated is an easy viewing invisible mounting system according to the present invention, generally designated by the reference numeral 10. The mounting system 10 comprises a right angle bracket, generally designated 12, defining a back vertical edge 14 for facing a wall, a top horizontal edge 16 for supporting a shelf or the like, and a long hypotenuse edge 18. The length of the bracket legs 14, 16 may be the same or differ, the edges 14, 16 being preferably planar and flat as they will mate with and ultimately be concealed by the front of the wall W (see FIGS. 2–3) and the bottom of the shelf S. Adjacent the orthogonal bracket corner 19, at least one of the edges 14, 16 defines a recessed portion 20, the recessed portion 20 on edge 14 being designated 20A and, when present, the recessed portion 20 on edge 16 being designated 20B. Where there are two such recessed portion 20, they meet at orthogonal corner 19 and the bracket 12 may be hung in either of two orientations—that is, with either of the two short edges 14, 16 facing the wall W and the other short edge 16, 14 facing the shelf S.

For expository purposes, the wall-facing edge will be referred to herein as the back vertical edge 14 and the shelf-facing edge will be referred to as the top horizontal edge 16. However, as illustrated in FIGS. 2 and 3, the orientation of the bracket 12 may be reversed such that the longer of the two short edges becomes the wall-facing edge 14 and the shorter of the two short edges becomes the shelf-facing edge 16.

The system additionally includes a substantially planar longitudinally extending hanger, generally designated 30, and preferably a plurality of such hangers 30A, 30B each disposed in a respective recessed portion 20A, 20B. The hanger 30 defines, adjacent a top end thereof (that is, the end adjacent the orthogonal corner 19 where the two recessed portions 20A, 20B meet), a circular aperture 32 configured and dimensioned to receive a fastener 34 therethrough to mount the hanger 30 (and hence the bracket 12) on the wall W. The fastener 34 may be a nail, screw, or any of the common variations thereof, such as the screw portion of an anchor screw. Only one fastener 34 will be used to mount the bracket 12 to the wall and hence only one fastener 34 need be supplied as part of the mounting system 10; however, a second fastener 34 is illustrated in phantom line in FIG. 1 to indicate that the fastener 34 may be used in connection with the circular aperture 32 of either hanger 30A, 30B. Remote from the top end of the hanger 30 (that is, farther spaced away from the orthogonal corner 19 of the bracket 12 and on the other side of the circular aperture 32 thereof), a longitudinally aligned and spaced-apart pair of elongated slots 40, 42 are oriented parallel to (i.e., vertically aligned along) a longitudinal axis of the hanger 30.

The mounting system 10 additionally includes a pair of fastener means 46, 48 for each hanger 30. Each fastener means 46, 48 extends through a respective one of the slots 40, 42 and secures the hanger 30 to the bracket edge 14, 16 while enabling limited relative sliding movement of the hanger 30 and the bracket 12 along a longitudinal axis of the hanger 30. In the case of the hanger 30A, relative vertical sliding movement is enabled, while in the case of hanger 30B, limited relative horizontal sliding movement is enabled. Thus, each hanger 30 may be slid in one direction (i.e., retracted) to hide the entirety of the hanger 30 within a recessed portion 20 of one bracket edge, or slid in the opposite direction (i.e., extended) to expose the circular aperture 32 of the hanger 30 for viewing during mounting of the hanger 30 on the wall W.

As previously noted, the circular aperture 32 and the pair of slots 40, 42 are aligned along a longitudinal axis of each respective hanger 30. The apertures 32 and the slots 40, 42 are countersunk on at least side, and preferably both sides, of the hanger 30. Each of the slots 40, 42 has a longitudinal length at least equal to the longitudinal length between the hanger top end (that is, the end of the hanger closest to the orthogonal corner of the bracket 12) and the bottom of the circular aperture 32 thereof, so that the slots 40, 42 enable a sliding movement of the hanger which exposes the entire circular aperture 32 for easy viewing by the mounter. The recessed portions 20 of the bracket 12 are sufficiently deep and long to receive the hanger 30 when the hanger top end (closest to the orthogonal corner 19 of the bracket 12) is flush with the orthogonal corner 19.

The back or wall-facing edge 50 of the shelf S defines a recess 52 so that the rear surface of the shelf S can be flush with the wall W as the top portion of the hanger 30A is received within the recess 52. The bottom surface of the shelf S defines a dowel-receiving hole 64 so that, eventually, a dowel 60 may be used to interconnect vertically aligned dowel-receiving hole 62 in the top horizontal edge 16 of bracket 12 and dowel-receiving hole 64 in the bottom surface of the shelf S.

The two hangers 30A and 30B and the accompanying two pairs of fastener means 46, 48 provide the mounter with the choice as to whether one hanger 30A or the other 30B should be used to mount the bracket 12 on the wall. On the other hand, where it is not desired to give such a choice to the mounter, only a single hanger 30 and its fastener means 46, 48 may be provided in a single wall-facing recessed portion 20.

The slidability of the retractable hanger or hangers 30 permits the mounting system to be packaged either in paperboard or plastic without the danger of the portion of a hanger projecting from a stationary bracket causing tearing of the packaging material. The provision of two retractable hangers 30A, 30B enables the mounter to exercise his choice of orientation for the bracket 12 simply by extending one hanger 30 (so that the circular aperture 32 thereof is visible and available for use) and retracting the other hanger 30 (so that it does not project out of its respective recessed portion 20).

Referring now to FIGS. 8–13, therein illustrated is a preferred embodiment 10' of the mounting system incorporating a shelf-lock system. The shelf-lock feature will be illustrated as being present on both hangers 30A, 30B, but alternatively could be present on only one of the hangers, with the other hanger being either of conventional design (that is, a stationary hanger) or a retractable hanger as described in connection with the first embodiment 10. Although each of the two hangers may be capable of providing the shelf-lock feature, obviously at any given time only one of the hangers will be used to provide the feature, and indeed possibly neither of the hangers will be used to provide the feature—that is, possibly both hangers will be used simply as retractable hangers of the type described hereinabove in connection with the first embodiment 10.

Referring now to FIGS. 8–13 in particular, the mounting system 10' is similar to the mounting system 10 of the first embodiment except that the hanger 130, in addition to the circular aperture 32 and adjacent slot 40, has a double ended key slot 142 (instead of the outer slot 42). The double ended key slot 142 is generally twice the length of the key slot 42 and includes a keyhole or central wide portion 180 of sufficient width to allow passage of the screw fastener 148 therethrough, an upper slot portion 182 and a lower slot portion 184. The two axially aligned slot portions 182, 184 each extend from and communicate with the central wide portion 180. Whereas the central wide portion 180 is of sufficient width to allow passage therethrough of both the threaded shank 186 of screw fastener 148 and the enlarged head 188 thereof, the two slot portions 182, 184 are configured and dimensioned to allow passage therethrough only of the shank 186 thereof. At least the central wide portion 180 and the upper slot portion 182 (that is, the slot portion closest to the orthogonal corner 19) are sufficiently countersunk or spaced from the adjacent recessed portion 20 such that the head 188 of screw fastener 148 can pass through the central wide portion 180 and then upwardly under upper slot portion 182.

Figure 10:
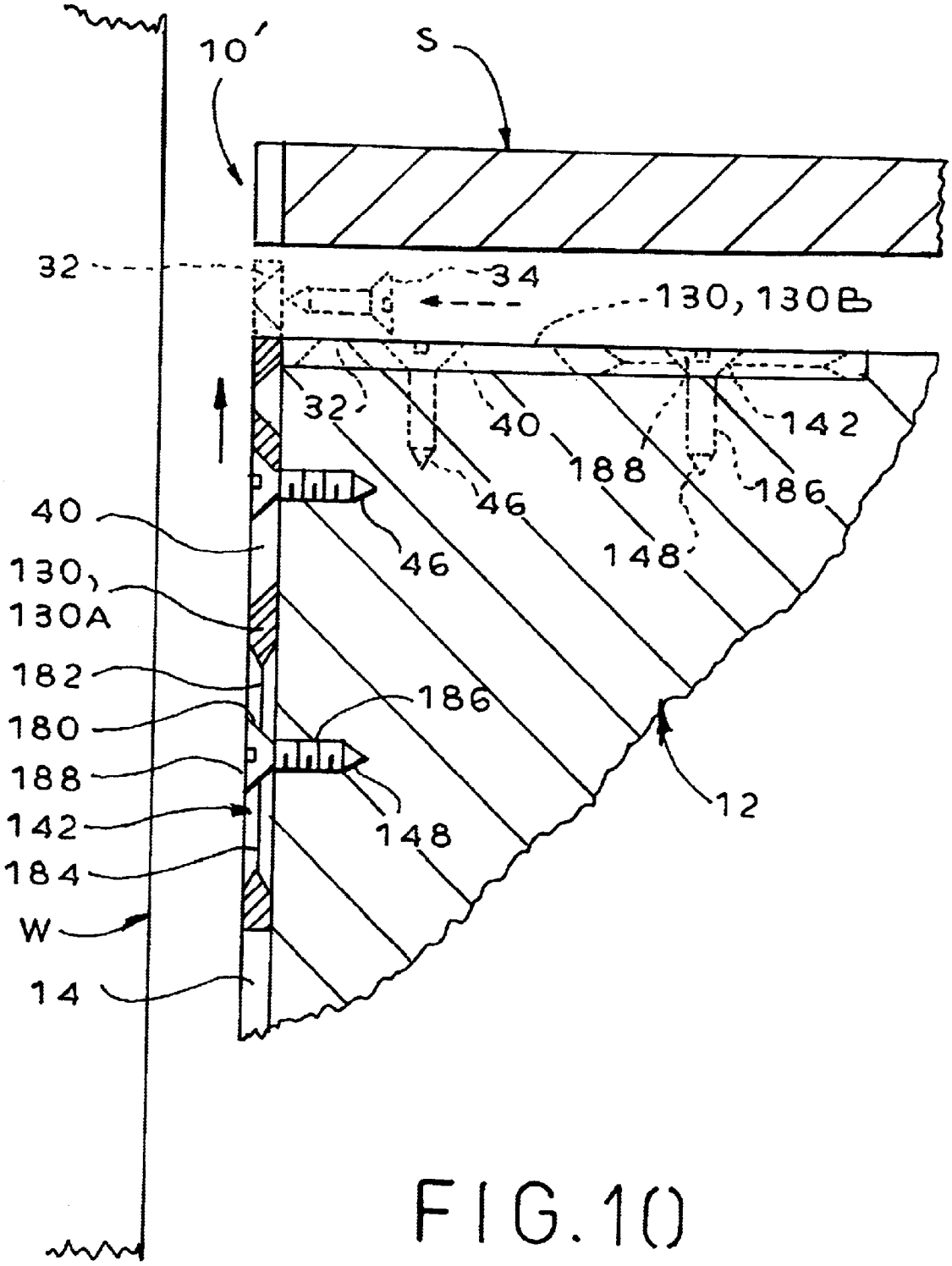
FIG. 10 is a fragmentary side elevational section taken along the line 10—10 of FIG. 8 with the top portion of the hanger being shown in phantom line in a position for hanging on the wall.

If the hanger 130 is utilized without the shelf-lock feature, it operates much as the hanger 30 of the first embodiment 10. Thus, referring now to FIG. 9 in particular, extension of the wall-facing hanger 130 causes the circular aperture 32 to extend above the orthogonal corner 19 of the bracket 12, the fastener means 46 to slide downwardly within slot 40, and the shank 186 of fastener means 148 to slide downwardly from the central wide portion 180 of slot 142 to the bottom of lower slot portion 184. FIG. 10 shows in solid line the wall-facing hanger 130A in its retracted position, and shows in phantom line the disposition of the circular aperture 32 above the bracket 12 when the hanger 30A is slid to its extended position for insertion of fastener 34 thereinto. Also illustrated in FIG. 10 is the second hanger 130B, with its circular aperture 32, middle slot 40 and double ended key slot 142, as well as the fastener means 46 and 148 passing through the respective slots 40 and 142.

Figure 11:
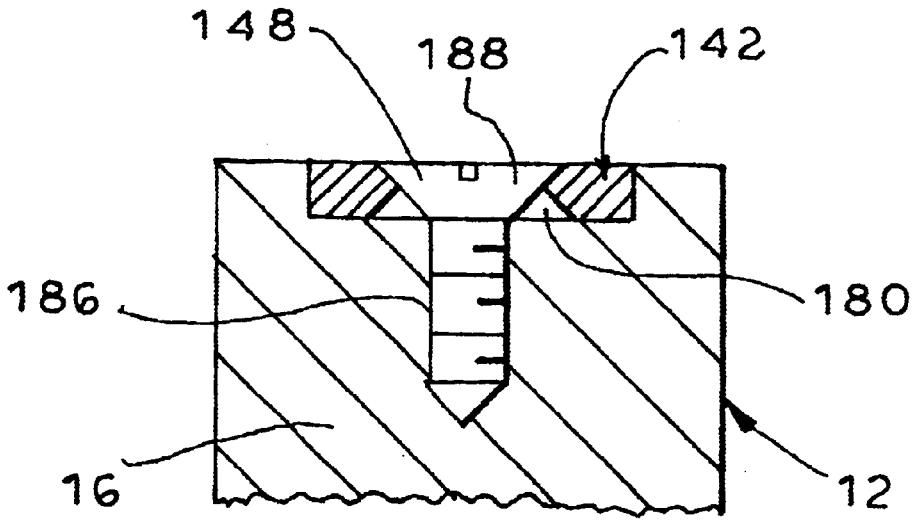
FIG. 11 is a fragmentary section taken along the line 11—11 of FIG. 8.

Referring now to FIG. 11, therein illustrated, to an enlarged scale, is the shank 186 of screw 148 passing through the central wide portion 186 of double ended key slot 142 and into the top horizontal surface 16 of bracket 12.

Figure 12:
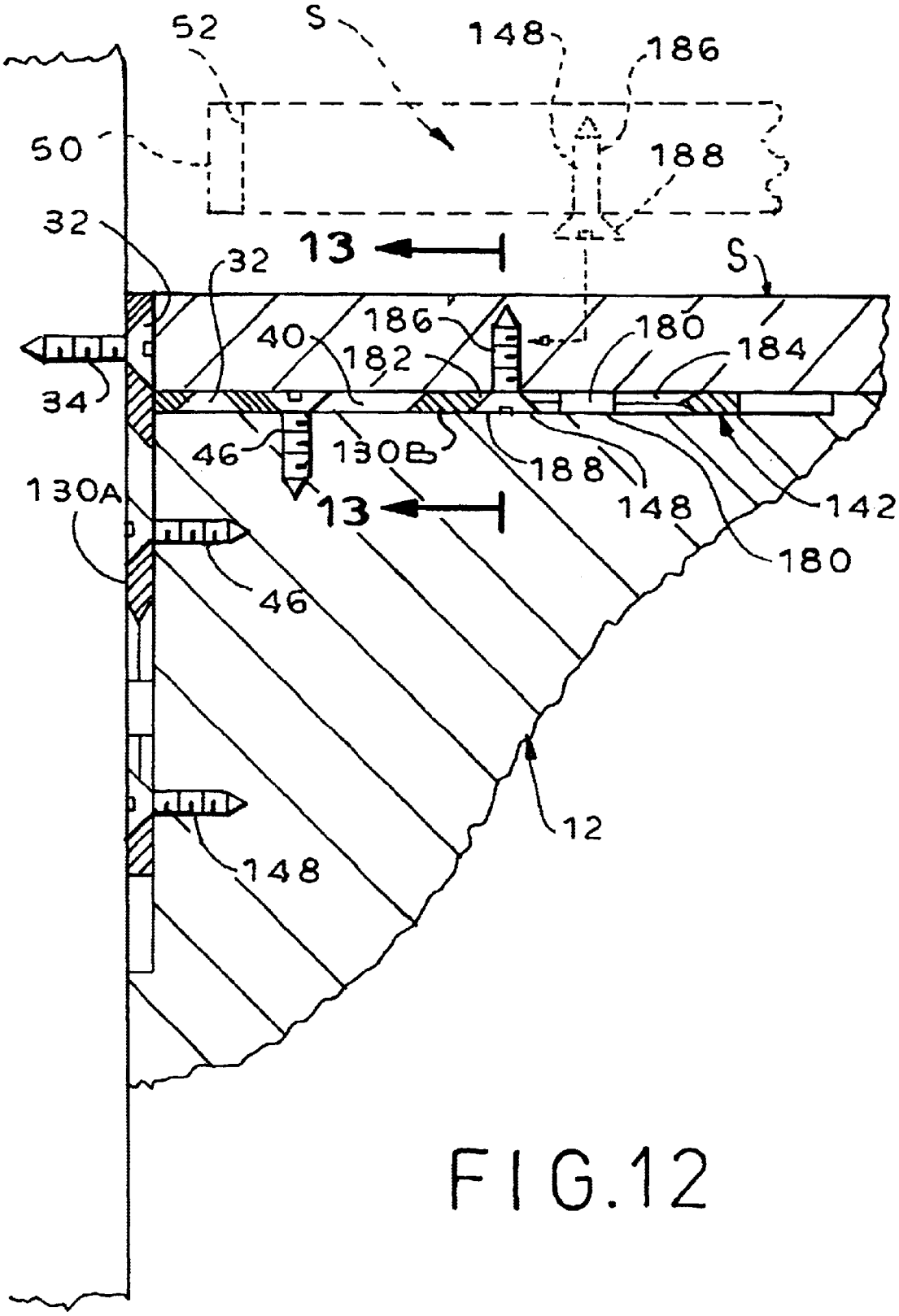
FIG. 12 is a fragmentary side elevational section showing the bracket secured to the wall by one hanger and the other hanger being used for its shelf-lock feature, the shelf being illustrated in phantom line prior to placement thereof on the mounting system.

Referring now to FIG. 12, therein illustrated in phantom line is the screw 148 after its removal by the mounter from the bracket 12 and hanger 130B (for example, with a screwdriver) and then its partial insertion by the mounter into the bottom surface of the shelf S. After this has been done (as illustrated in phantom line), the head 188 of screw 148 is inserted through the central wide portion 180 of the double ended key slot 142 by the mounter placing the shelf S atop the bracket 12 and hanger 130B, but with the wall-facing edge 50 of the shelf S being slightly spaced from the wall W. The shelf S is then moved back against the wall W by the mounter so that the top portion of the hanger 130A enters the recess 52 at the rear of shelf S and the head 188 of screw 148 passes under the countersunk or raised edges of the slot portion 182. This action secures the shelf S to the hanger 130B, and thus to the bracket 12, against a simple lifting movement of shelf S.

Figure 13:
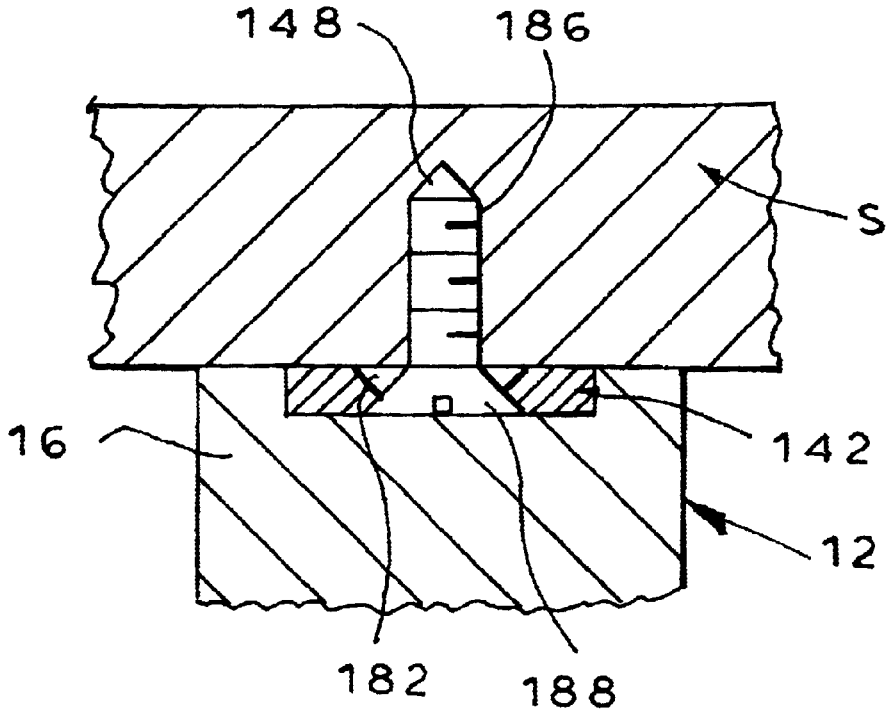
FIG. 13 is a fragmentary section taken along the line 13—13 of FIG. 12.

FIG. 13 shows, to an enlarged scale, the capture of the enlarged head 188 of screw 148 by the slot portion 182 of the double ended key slot 142.

It will be appreciated that the slot portion 184 of double ended key slot 142 serves no function when the hanger 130B is being used only for its shelf-lock feature. Nonetheless, the provision of the two double ended key slots 142 is preferred as it provides the mounter with the option of mounting the bracket 12 to the wall W in either of two orientations with one hanger and still having the other hanger afford a shelf-lock feature.

To summarize, the present invention provides an easy viewing invisible mounting system wherein the hanger is easily mounted on the wall because the hanging (top) aperture thereof extends above the horizontal edge of the bracket for easy viewing during the mounting procedure and yet is entirely covered by the shelf which is later placed on the bracket. The mounting system prior to use has no portion of the hanger projecting outwardly from the bracket, thus reducing the likelihood of tearing of the package. It also enables the mounter to decide the orientation of the bracket on the wall and allows the relative positions of the shelf and the bracket to be fixed without the use of a dowel or drilling of a dowel-receiving recess in the shelf. The mounting system is simple and inexpensive to manufacture and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An easy viewing invisible mounting system comprising:

(A) a right angle bracket defining a vertical edge for facing a wall and a top horizontal edge for supporting a shelf;

(B) a substantially planar, longitudinally extending hanger defining:

(i) adjacent a top end thereof, a circular aperture configured and dimensioned to receive a fastener therethrough to mount said hanger on the wall, and (ii) remote from said top end thereof, a longitudinally aligned and spaced apart pair of elongated slots oriented parallel to a longitudinal axis of said hanger; and (C) a pair of fastener means, each fastener means extending through a respective one of said slots and securing said hanger to said bracket vertical edge while enabling limited relative vertical sliding movement of said hanger and said bracket along a longitudinal axis of said hanger;

whereby said hanger may be slid in one direction for storage with the entirety of said hanger disposed on said bracket vertical edge or slid in the opposite direction to expose said aperture above said bracket for viewing during mounting of said hanger on the wall.

2. The system of claim 1 where said aperture and said pair of slots are vertically aligned along a longitudinal axis of said hanger.

3. The system of claim 1 wherein each of said slots has a longitudinal length at least equal to the longitudinal length between said hanger top end and the bottom of said aperture.

4. The system of claim 1 wherein said aperture and said slots are each countersunk on at least one side of said hanger.

5. The system of claim 1 wherein said bracket vertical edge defines a recess configured and dimensioned to receive said hanger with said hanger top end flush with said bracket top horizontal edge.

6. The system of claim 1 additionally including a second hanger and a second pair of said fastener means, said second pair of said fastener means securing said second hanger to said bracket top horizontal edge.

7. The system of claim 6 wherein said second pair of fastener means enables limited relative horizontal sliding movement of said second hanger and said bracket along a longitudinal axis of said second hanger, whereby either said hanger or said second hanger may be used to mount said bracket on the wall, as desired by a mounter thereof.

8. The system of claim 7 wherein one of said slots of said second hanger is a double keyhole slot having a relatively wide central keyhole, a first narrow portion communicating with and extending toward said bracket vertical edge, and a second narrow portion communicating with and extending away from said bracket vertical edge.

9. The system of claim 8 wherein one said fastener means has a shank and an enlarged head, said shank initially extending through said central keyhole.

10. The system of claim 9 wherein said one fastener means is removable from said keyhole slot by a user and said shank is then securable by the user to the bottom surface of a shelf such that said enlarged head thereof projects downwardly from the bottom surface of said shelf for insertion through said central keyhole and thereafter for sliding movement forwardly into said first narrow portion of said keyhole slot as the shelf is placed downwardly on said bracket top horizontal edge and thereafter slid towards the wall with said enlarged head being trapped by said first narrow portion of said keyhole slot.

11. The system of claim 6 wherein one of said slots of said second hanger is a double-ended keyhole slot having a relatively wide central keyhole and a narrow portion communicating with and extending toward said bracket vertical edge.

12. The system of claim 11 wherein one said fastener means has a shank and an enlarged head, said shank initially extending through said central keyhole.

13. The system of claim 12 wherein said one fastener means is removable from said keyhole slot by the user and said shank is then securable by the user to the bottom surface of a shelf such that said enlarged head thereof projects downwardly from the bottom surface of said shelf for insertion through said central keyhole and thereafter for sliding movement forwardly into said narrow portion of said keyhole slot as the shelf is placed downwardly on said bracket top horizontal edge and thereafter slid towards the wall with said enlarged head being trapped by said narrow portion of said keyhole slot.

14. In combination, a pair of the mounting systems of claim 1 and a shelf adapted to be mounted generally horizontally on the wall by said mounting systems, said shelf being sufficiently thick to conceal said hanger top ends from view when said shelf is mounted on said bracket top horizontal edges.

15. The system of claim 14 additionally including a dowel, the bottom surface of said shelf and said bracket top horizontal surface each defining an aperture configured and dimensioned to receive therein a respective end of said dowel.

16. The system of claim 1 additionally comprising:

(D) a substantially planar, longitudinally extending second hanger defining:

(i) adjacent a top end thereof, a second circular aperture configured and dimensioned to receive a fastener therethrough to mount said second hanger on the wall, and (ii) remote from said top end thereof, a longitudinally aligned and spaced apart pair of elongated second slots oriented parallel to a longitudinal axis of said second hanger; and (E) a pair of second fastener means, each second fastener means extending through a respective one of said second slots and securing said second hanger to said bracket horizontal edge while enabling limited relative sliding movement of said second hanger and said bracket along a longitudinal axis of said second hanger; whereby said second hanger may be slid in one direction for storage with the entirety of said second hanger disposed on said bracket horizontal edge or slid in the opposite direction to expose said second aperture above said bracket for viewing during mounting of said second hanger on the wall.

17. An easy viewing invisible mounting system comprising:

(A) a right angle bracket defining first and second orthogonal edges, a first edge for facing a wall and a second edge for supporting a shelf;

(B) a substantially planar, longitudinally extending hanger on one said bracket edge defining:

(i) adjacent the other of said bracket edges, a circular aperture configured and dimensioned to receive a fastener therethrough to mount said hanger on the wall, and (ii) remote from the other of said bracket edges, a longitudinally aligned and spaced apart pair of elongated slots oriented parallel to a longitudinal axis of said hanger; and (C) a pair of fastener means, each fastener means extending through a respective one of said slots and securing said hanger to said one bracket edge while enabling limited relative sliding movement of said hanger and said bracket along a longitudinal axis of said hanger; whereby said hanger may be slid in one direction for storage with the entirety of said hanger disposed on said one bracket edge or slid in the opposite direction to expose said aperture above said bracket for viewing during mounting of said hanger on the wall;

(D) a substantially planar, longitudinally extending second hanger on said other bracket edge defining:

(i) adjacent said one bracket edge, a circular aperture configured and dimensioned to receive a fastener therethrough to mount said second hanger on the wall, and (ii) remote from said one bracket edge, a longitudinally aligned and spaced apart pair of elongated second slots oriented parallel to a longitudinal axis of said second hanger; and (E) a pair of second fastener means, each second fastener means extending through a respective one of said second slots and securing said second hanger to said other bracket edge while enabling limited relative vertical sliding movement of said second hanger and said bracket along a longitudinal axis of said second hanger; whereby said second hanger may be slid in one direction for storage with the entirety of said second hanger disposed on said other bracket edge or slid in the opposite direction to expose said aperture above said bracket for viewing during mounting of said second hanger on the wall.

18. The system of claim 17 wherein one of said second slots of said second hanger is a double keyhole slot having a relatively wide central keyhole, a first narrow portion communicating with and extending toward said one bracket edge, and a second narrow portion communicating with and extending away from said one bracket edge.

19. The system of claim 18 wherein one of said second fastener means has a shank and an enlarged head, said shank initially extending through said central keyhole.

20. The system of claim 19 wherein said one second fastener means is removable from said keyhole slot by the user and said shank is then securable by the user to the bottom surface of a shelf such that said enlarged head thereof projects downwardly from the bottom surface of said shelf for insertion through said central keyhole and thereafter for sliding movement forwardly into said first narrow portion of said keyhole slot as the shelf is placed downwardly on said one bracket edge and thereafter slid towards the wall with said enlarged head being trapped by said first narrow portion of said keyhole slot.

21. An easy viewing invisible mounting system comprising:

(A) a right angle bracket defining first and second orthogonal edges, a first edge for facing a wall and a second edge for supporting a shelf;

(B) a substantially planar, longitudinally extending hanger on one said bracket edge defining:

(i) adjacent the other of said bracket edges, a circular aperture configured and dimensioned to receive a fastener therethrough to mount said hanger on the wall, and (ii) remote from the other of said bracket edges, a longitudinally aligned and spaced apart pair of elongated slots oriented parallel to a longitudinal axis of said hanger; and (C) a pair of fastener means, each fastener means extending through a respective one of said slots and securing said hanger to said one bracket edge while enabling limited relative sliding movement of said hanger and said bracket along a longitudinal axis of said hanger; whereby said hanger may be slid in one direction for storage with the entirety of said hanger disposed on said one bracket edge or slid in the opposite direction to expose said aperture above said bracket for viewing during mounting of said hanger on the wall;

(D) a stationary substantially planar, longitudinally extending second hanger on said other bracket edge defining a second circular aperture and an elongated second slot oriented parallel to a longitudinal axis of said second hanger, said second slot of said second hanger being a keyhole slot having a relatively wide keyhole and a narrow portion communicating with and extending toward said one bracket edge; and (E) a pair of second fastener means, one of said second fastener means having a shank and an enlarged head, said shank thereof initially extending through said keyhole, and the other of said second fastener means extending through said second circular aperture and securing said second hanger to said other bracket edge; said one second fastener means being removable from said keyhole slot by the user and said shank thereof then being securable by the user to the bottom surface of a shelf such that said enlarged head thereof projects downwardly from the bottom surface of said shelf for insertion through said keyhole and thereafter for sliding movement forwardly into said narrow portion of said keyhole slot as the shelf is placed downwardly on said other bracket edge and thereafter slid towards the wall with said enlarged head being trapped by said narrow portion of said keyhole slot.

* * * * *